United States Patent [19]

Gringer

[11] Patent Number: 4,575,936

[45] Date of Patent: Mar. 18, 1986

[54] BLADE RETAINING TOOL HEAD

[76] Inventor: Donald Gringer, One Bishop Rd., Bedford, N.Y. 10506

[21] Appl. No.: 698,780

[22] Filed: Feb. 6, 1985

[51] Int. Cl.[4] ..... B26B 5/00

[52] U.S. Cl. ..... 30/169; 30/330; 30/332; 279/39

[58] Field of Search ..... 30/169, 171, 330, 331, 30/332, 333; 279/38, 39

[56] References Cited

U.S. PATENT DOCUMENTS

| | | | |
|---|---|---|---|
| 431,424 | 7/1890 | Webster | 279/39 |
| 743,647 | 11/1903 | La Croix | 279/39 |
| 842,275 | 1/1907 | Traut | 30/169 X |
| 854,915 | 5/1907 | Speece | 30/331 |
| 857,400 | 6/1907 | Harrington | 279/39 |
| 908,629 | 1/1909 | Vasey | 30/169 X |
| 2,317,041 | 4/1943 | Ericksen | 30/171 |
| 2,610,401 | 9/1952 | Vosbikian | 30/332 |
| 2,654,135 | 10/1953 | Grizzard | 279/38 X |

*Primary Examiner*—Jimmy C. Peters

*Attorney, Agent, or Firm*—Stiefel, Gross, Kurland & Pavane

[57] ABSTRACT

An improved tool head for releasably retaining a blade includes a body and a clamping member pivotally hinged together for relative movement therebetween by rotation of a threaded operating member. The operating member is rotatable to axially move the same into threaded engagement with the body and clamping member and, at a final point in its axial translation, contacts a camming structure on the clamping member. Engagement of the operating member with the camming structure applies a laterally directed force to the clamping member, pivoting the same about its hinged connection to the body and carrying a pair of blade receiving lips on the body and clamping member into relative blade-retaining proximity to firmly secure a blade between the lips.

20 Claims, 10 Drawing Figures

30
32
34
36
38
40
42
44
46
48
50
52
54
56
58
60
62
64
66
68
69
70
72
8
9
38'
40'
58'
62'
64'
66'
68'
76
78

BLADE RETAINING TOOL HEAD

TECHNICAL FIELD

The present invention is directed to a tool head for securely and releasably retaining a blade and, more particularly, to such a tool head incorporating an improved arrangement for tightly holding and readily releasing the blade with heretofore unrealized reliability, repeatability and convenience.

BACKGROUND ART

Tool heads capable of holding a blade are used in numerous minipulable implements intended for myriad applications in which the worker must, for example, cut into a workpiece or non-destructively scrape along a surface or substrate. One such application concerns wallpaper stripping tools manually operable for enabling separation and removal of a wall covering without inflicting damage on the underlying support surface.

A conventional wallpaper stripping tool, as heretofore known, is illustrated in FIGS. 1 and 2 and there identified by the general reference numeral 10. Tool 10 comprises a head 12 and a handle 14 elongated to impart a leveraged mechanical advantage in use of the tool and integrally fixed to or otherwise depending from the head. The major portion of the tool head is formed as a shell or body 16 to which handle 14 is secured at one of the body and which engages, at its opposite tapered end, an elongated blade 18 having a single honed cutting edge 20. More particularly, and as best seen in FIG. 2, the blade 18 is held between the tapered end of body 16 and a similarly tapered end of a cooperating clamping member 22 which is releasably secured to body 16 by a conventional threaded screw 24. Thus, by rotatably loosening screw 24 to loosen the securement of member 22 from body 16, blade 18 is freed from clamped engagement between the body and clamping member and may be removed and/or replaced; reverse rotation of the screw conversely effective to grip a new blade between the tapered ends. This arrangement also desirably enables positional reversal of the retained blade—so that its cutting edge 20 is then disposed protectedly between the tapered clamping ends of body 16 and member 22—during periods of storage or non-use of the tool to thereby prevent inadvertent injury to a worker or damage to nearby objects.

In use, the conventional tool 10 is held so as to apply the cutting edge of the blade to the wall to be stripped at a typical angle of approximately 10 to 30 degrees relative to the work surface. In order to facilitate removal of the wallpaper or other covering, the same is commonly first wet down or moistened with water. The tool handle is then manipulated to wedge the blade under the wall covering and move the blade along thereunder, separating the covering from the supporting wall surface. The illustrated taper of the blade holding edge faces of the tool head is necessary to prevent the head from scraping and damaging the wall as the tool-held blade is moved along its surface, for which reason the head of screw 24 is also generally recessed in body 16 as may be readily seen at 25 in FIG. 2.

This prior art arrangement for holding a blade in a tool head presents, however, a number of significant operating and structural drawbacks. The provision of a rotatable screw to retain the blade between the body and clamping member requires that a user of the tool have and use another tool—i.e. a screwdriver—with which to loosen and tighten the screw, and thereby release and secure the blade, in the tool head. The momentary unavailability of a screwdriver, or a user's disinclination to locate and/or use one, often leads a worker to leave the blade with its cutting edge outwardly exposed during brief—and even during extended—periods of non-use, dangerously presenting numerous opportunities for serious personal injury and property damage.

Wetting of the wall covering prior to scraping is known to facilitate separation of the covering from the wall surface by loosening or dissolving the glue bond existing therebetween. As the blade end of the tool head is then wedged and moved along between the covering and supporting wall surface, a gummy mixture of moistened glue and bits of shreaded wall covering material is forced along the tapered faces of the tool head, collecting in both the screw-receiving recess and the screw head spline. The screw thereby becomes difficult, at best, to rotate with a screwdriver, significantly interfering with the user's ability to tighten the blade-securing screw—as is necessary from time-to-time—and further discouraging reversing of the blade to sheath the cutting edge for safety during periods of non-use. Moreover, this caked mixture, wet or dry, can be extremely difficult to remove in cleaning the tool.

Yet another problem with the prior art wallpaper scraper construction 10 concerns the reliability of the screw-based arrangement for securely retaining the blade in the tool head. Tapering of the outer faces of body 16 and clamping member 22—which is necessary to lessen the possible infliction of damage to the wall surface being scraped—significantly reduces the thickness of the tool head through which retaining screw 24 is rotatably journaled. As a consequence, the length of the thread defined in clamping member 22 for engagement with the thread of screw 24 is relatively short; repeated tightening of the screw to maintain the blade securely held in the tool head often results in early stripping of the threads, thereby rendering the tool head useless for continued use. In an effort to overcome this deficiency, it is known to incorporate a boss 26, as seen in FIG. 2, projecting outward from the tapered face of clamping member 22 and located to provide additional length for the screw-receiving thread in member 22. Although the provision of such a boss does somewhat, although not entirely, alleviate the problem of early thread stripping, it raises the further difficulty of placing an upstanding projection on the otherwise smoothly tapered face of clamping member 22 which can easily, and often does, become caught on and destructively scrape the surface being stripped of its wall covering.

It is accordingly the desideratum of the present invention to provide a tool head capable of securely and releasably retaining a blade and incorporating an improved releasable retaining mechanism which overcomes the problems inherent in prior art devices.

BRIEF DESCRIPTION OF THE DRAWINGS

In the drawings, wherein similar reference characters denotes similar elements throughout the several views.

BEST MODE FOR CARRYING OUT THE INVENTION

Figure 1:
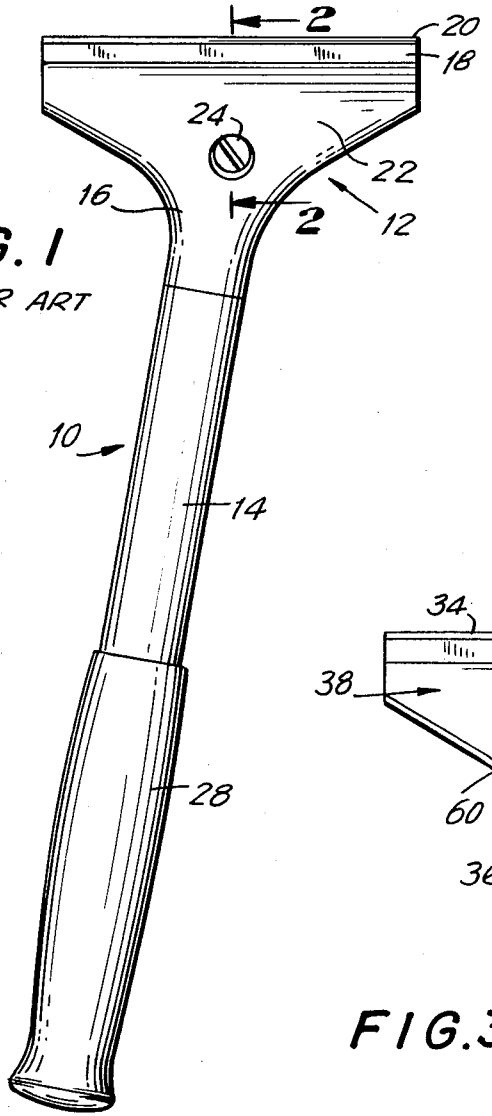
FIG. 1 PRIOR ART
FIG. 1 is a plan view of a prior art wallpaper stripping tool.
Figure 2:
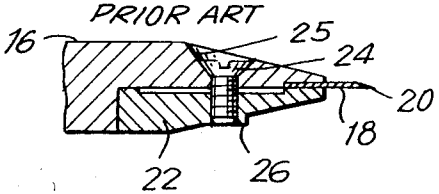
FIG. 2 PRIOR ART
FIG. 2 is a cross-sectional view, partly broken away, as seen along the lines 2—2 in FIG. 1.
Figure 3:
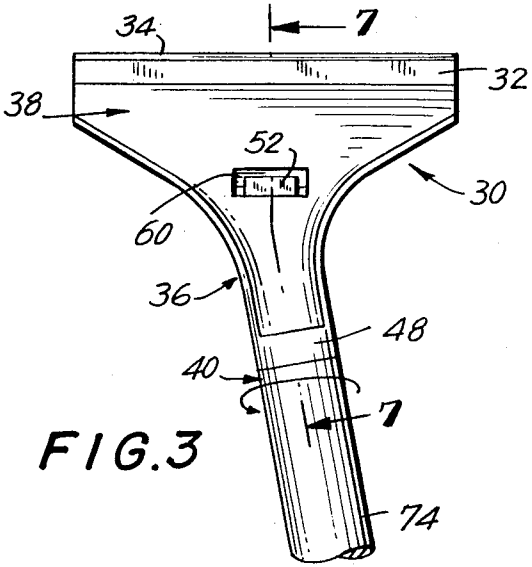
FIG. 3 is a sectional plan view of an improved wallpaper stripping tool incorporating a tool head for retaining a blade and constructed in accordance with the teaching of the present invention.

Referring now to FIGS. 3 to 9, an improved tool head 30 of the present invention is adapted for securely and releasably retaining a blade 32. In the specific application of head 30 herein described—i.e. for use as a wallpaper stripping tool—the blade is typically of the type which is rectangularly elongated and incorporates a single honed or sharpened edge 34 along its length; the opposite edge of blade 32 is unsharpened or dull so that the blade may be positionally reversed in a manner heretofore known to protectively sheath the honed edge 34 and thereby avoid inadvertent personal injury or property damage resulting from contact therewtih. Those skilled in the art will nevertheless recognize and appreciate that tool head 30 may be utilized in the constructions of a wide variety of tools for intended numerous purposes other than the wallpaper stripping function herein disclosed. Moreover, the inventive head 30 is readily adaptable for receiving, in lieu of single or double edged blades, virtually any device or utensil for performing work where ready releasability is desirable or required. Thus, and solely by way of example, a suitably modified tool head 30 could releasably hold a sponge for mopping or like cleaning of surfaces or objects, or a polishing or dust cloth. The present disclosure of a blade-holding application for the tool head is therefore merely intended to illustrate a particularly advantageous implementation and use of the invention.

In overview, the disclosed embodiment of tool head 30 is formed of three principal parts, namely a fixed or main body 36, a clamping member 38 and an operating member 40. For convenience and structural integrity, all three parts may be stamped or otherwise formed of a metallic material such as steel, or cast of aluminum or zinc, although rigid plastics or numerous other construction materials may alternatively be employed at the option of the manufacturer. Body 36 and clamping member 38 are hinged for pivotal movement as indicated at 42, this pivotal movement carrying their tapered forward ends into and out of blade retaining proximity as will hereinafter become clear. By an especially advantageous arrangement, rotation of operating member 40 over a relatively small angular range effects sufficient relative pivoting of the clamping member and body to carry their blade-receiving ends into and out of close proximity sufficient for secure retention and ready release, respectively, of the blade.

Figure 5:
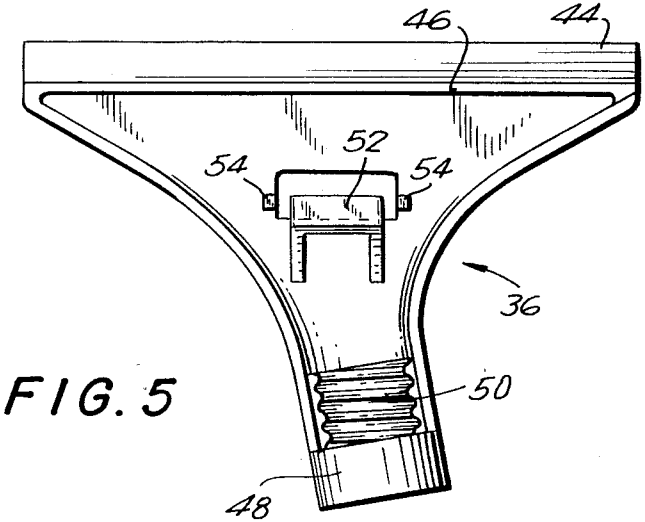
FIG. 5 is a plan view of the main body or jaw of the inventive tool head.
Figures 6, 7, 8, 9, 10:
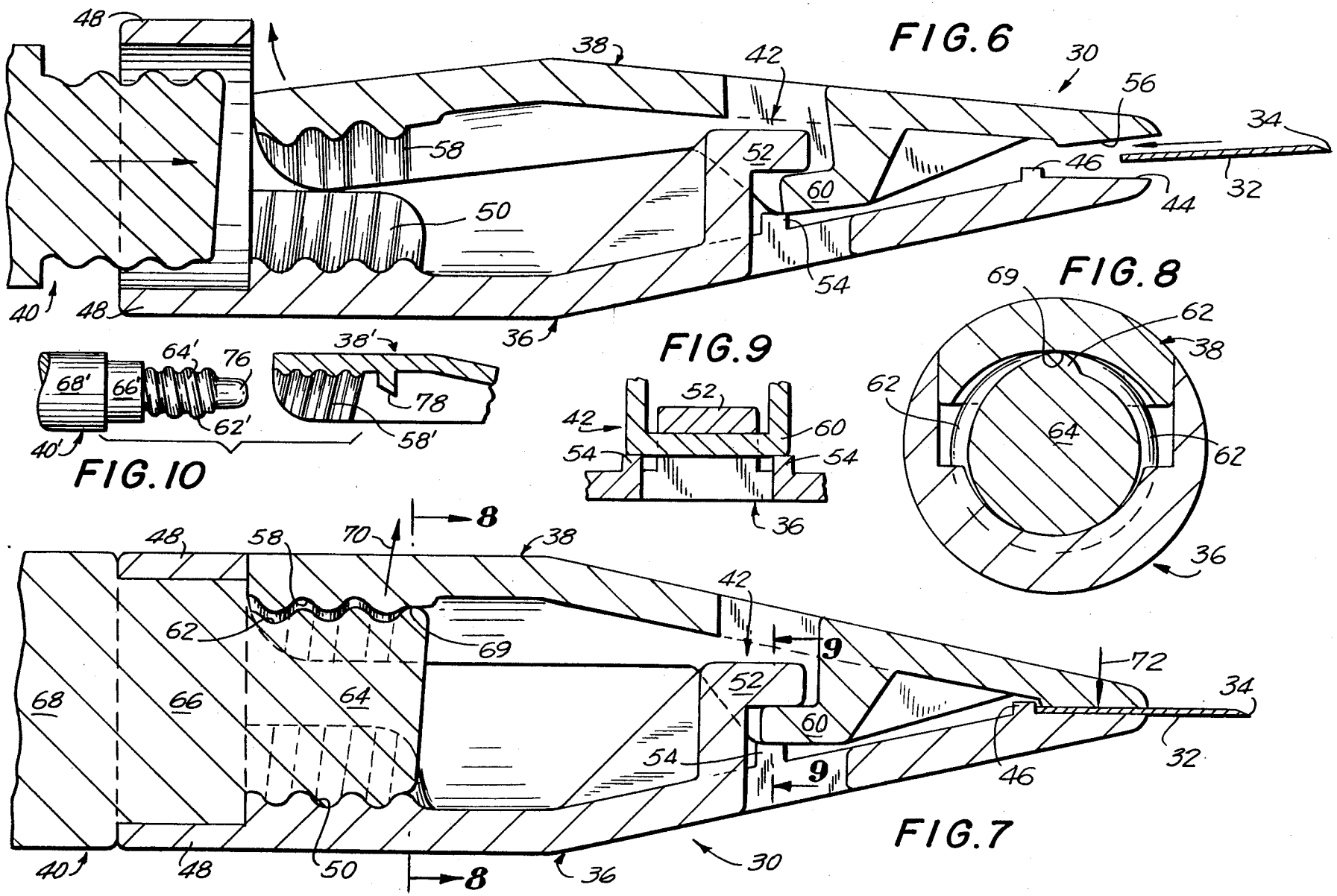
FIG. 6 is a side sectional elevation of the inventive tool head depicting its various elements in a pre-engagement condition.
FIG. 7 is a side sectional elevation similar to FIG. 6 wherein the interengaged elements of the tool head are depicted in blade-clamping condition.
FIG. 8 is a cross-sectional view as seen along the lines 8—8 FIG. 7.
FIG. 9 is a cross-sectional view, partly broken away, of the cooperatively interengaging hinge structure as seen along the lines 9—9 in FIG. 7.
FIG. 10 is a side sectional elevation, partly broken away, of a modified camming arrangement of the operating and clamping members.

Body 36, as perhaps best seen in FIGS. 5 and 6, includes a blade seating or receiving lip 44 at its forward end and an immediately adjacent upstanding rib 46 which serves as a stop to prevent rearward slippage or movement of blade 31 during wallpaper stripping use of the tool. At the rear or opposite end of body 12 a collar 48 of predetermined internal diameter is unitarily formed adjacent a radially inwardly directed substantially semicircular thread 50 which, in conjunction with complimentary structure on clamping member 38, forms a single, substantially continuous thread in the operative interengaged arrangement of the clamping member with body 36. Except as hereinafter discussed, thread 50 is preferably of standard configuration throughout in that its root-to-crest height and crest-to-crest spacings are constant along its entirety.

A flanged hook 52 projects unitarily upward out of the base plane of body 16 intermediate thread 50 and blade receiving lip 44. In the illustrated embodiment, hook 42 has a substantially L-shaped profile and may, if desired, be punched out of the construction material of body 36 thus leaving a void or opening therebelow. Hook 52 comprises one-half of the engaging portion of hinge 42 about which body 36 and clamping member 38 operatively pivot to retain and release a blade 32. A pair of upwardly projecting bosses 54—which could instead be formed as one or a greater number of the same—lie forwardly adjacent hook 52 and serve as a fulcrum for relative pivotal movement of clamping member 38 as will hereinafter become clear.

Figure 4:
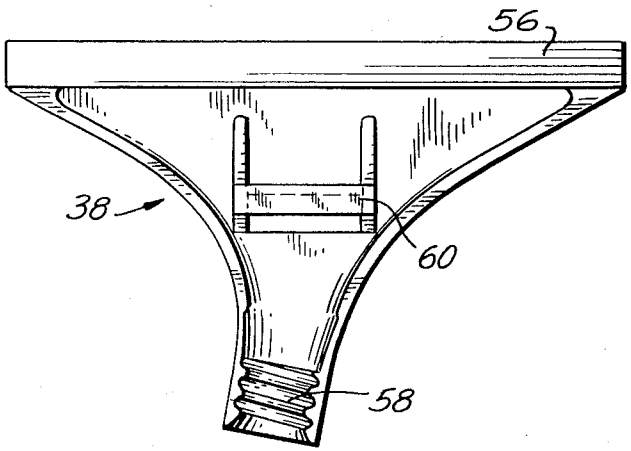
FIG. 4 is a plan view of the clamping jaw of the inventive tool head.

Turning now to FIGS. 4 and 6, clamping member 38 similarly carries a blade receiving lip 56 at its tapered forward end and an inwardly directed substantially semicircular thread 58 at its opposite rearward end. Like body thread 50, thread 58 is preferably, except to the extent hereafter discussed, of standard configuration in its root-to-crest height and inter-crest spacings. When body 36 and clamping member 38 are interengagedly disposed as shown in FIG. 7 for operative use of tool head 30, their substantially contiguously positioned internal threads 50, 58 together define a single, substantially continuous filamentary thread engageable with threaded operating member 40. As thus used herein, the term "substantially continuous" is intended to convey that even though the lateral edges of substantially semicircular threads 50, 58 might not actually abut whereby the lateral edges are in fact spaced apart in a particular embodiment of tool head 30, they will nonetheless together rotatably receive and engage a correspondingly dimensioned complimentary thread of, for example, the operating member 40 just as though threads 50, 58 were actually formed as a single unitary continuous thread. This should be readily understood by those skilled in the art from an examination of FIGS. 6 and 7 of the drawings.

Clamping member 38 further includes an inwardly directed flanged hook 60 intermediately positioned between blade receiving lip 56 and semicircular thread 58. In the illustrated embodiment, hook 60 has a substantially L-shaped profile and, as with hook 52 of body 36, may be unitarily punched or otherwise integrally formed from the construction material of clamping member 38. As should be readily apparent from FIGS. 6, 7 and 9, the thickness of the flange portion of hook 60 substantially corresponds to—i.e. is just slightly less than—the spacing between the corresponding flange portion of body hook 52 and the opposing surface of each boss 54 so as to permit fulcrummed relative pivotal movement between hooks 52 and 60 which together define the interengaging structure of pivotal hinge 42.

Operating member 40 carries a single continuous outwardly directed thread 62 about its circular periphery at or proximate its forward end 64. Thread 62 is preferably of standard or regular configuration for ready rotative engagement with the substantially continuous filament of contiguously adjacent threads 50, 58. Immediately rearwardly adjacent the forward end 64 of operating member 40 is an intermediate portion 66 of relatively increased diameter substantially corresponding to the internal diameter of body collar 48 and, as seen in FIG. 7, of substantially equal axial length. Still further rearward along operating member 40 is another portion 68 of further increased diameter which may, as in the illustrated embodiment, substantially conform to the external or peripheral diameter of body collar 48.

An elongated handle 74 axially depends, in the currently preferred embodiment shown in the drawings, from the rearmost operating member portion 68. Handle 74 may advantageously incorporate an encircling rubber grip such as that designated 28 in the prior art tool 10 (FIG. 1) at its end furthest from operating member 40 to improve the user's ability to hold and manipulate the tool head 30. Although handle 74 is illustrated as unitarily formed with operating member 40 in FIG. 3 of the drawing, those skilled in the art will recognize that various alternative arrangements are available for integrally connecting a separately formed handle and operating member, and such alternatives are deemed to be within the scope and contemplation of the invention.

The tool head 30 of the present invention is assembled by initially interengaging the mutually interlocking complimentary hook structures 52, 60 on body 36 and clamping member 38, respectively, as seen in FIG. 6. The forward end 64 of operating member 40 is then inserted into body collar 48 and rotated so as to engage operating member thread 62 with the substantially contiguous threads 50, 58 of body 36 and clamping member 38 respectively. This rotative interengagement of the threads of the operating member body and clamping member prevents mutual release of hooks 52, 60 of hinge structure 42 to thereby interlock body 36 and clamping member 38 for captive relative pivotal movement therebetween. The engaging rotation of operating member 40 causes the same to axially translate along and between the body and clamping member and is continued until the operating member is fully inserted—that is, until no further forward axial translation of the operating member is possible. As should be apparent in FIG. 7, the lateral wall portions of operating member 40 separating its forward and intermediate portions 64, 66, and its intermediate and rearmost portions 66, 68, abuttedly cooperate with corresponding lateral wall portions on body 36 and clamping member 38 to define stops preventing further forward axial translation of the operating member therebeyond.

At this point, it should be explained that clamping member 38 additionally includes a camming means cooperable with the operating member to effect a relative pivotal movement of the clamping member and body which carries blade-receiving lips 56, 44 toward one another at the final, fully inserted position of the operating member. In the currently preferred embodiment herein disclosed, the camming means comprises a modified portion 69 of clamping member thread 58 at the forwardmost end thereof which operably engages the operating member thread 62. More particularly, the last or forward root of thread 58 is at least partially filled in—i.e. extends further radially inward (has less depth) than the remaining root portions of the thread—so that, as the forwardmost end of operating member thread 62 engages the same, clamping member 68 is pivoted upwardly (in FIG. 7) creating the space seen in FIG. 7 between the rearward remainder of clamping member thread 58 and operating member thread 62. This upward pivoting of the rearward end of the clamping member, as depicted by arrow 70 (FIG. 7), translates at the opposite or forward end of clamping member 38 to downward movement of blade-receiving lip 56 with respect to the opposed lip 44 of relatively stationary body 36, as depicted by arrow 72 in FIG. 7.

To use the newly-assembled tool head 30, operating member 40 is initially reverse rotated to rearwardly axially translate the same out of engagement with the clamping member camming thread portion 69. Preferably, only relatively slight rotation of the operating member should be necessary to effect such disengagement and may, for example, be on the order of one-quarter to one-half turn of operating member 40. With thread 62 free of modified camming thread portion 69, clamping member 38 is imparted with sufficient movability or play to enable it to predeterminately pivot move about hinge 42 and relative to body 36 such that lips 44, 56 are moved apart. The resulting spacing or separation between lips 44 and 56 should be sufficient to enable ready insertion (or corresponding release) of a blade 32 between the opposed clamping lips with the rear edge of the blade abutting blade stop rib 46.

Operating member 40 is then rotated to axially translate the same to its forwardmost or fully inserted position wherein its thread 62 engagedly abuts modified camming thread portion 69 on clamping member 38. Member 38 is thereby pivoted about hinge 42 to carry its lip 56 into blade retaining proximity with body lip 44 for securely clamping the blade 32 therebetween.

The present invention accordingly provides a tool head incorporating an improved arrangement for securely retaining and enabling ready release of a blade. The invention overcomes the various problems inherent in prior art devices and provides a reliability and ease of extended use heretofore unknown in comparable devices.

Moreover, although the particular embodiment herein described and disclosed in the drawing is currently preferred, those skilled in the art will recognize and appreciate the wide range and variety of modifications that may be applied to the disclosed structure without departing from the broad teachings of the invention. For example, the pivotal hinge structure 42 could assume a range of configurations incorporating either releasable interengagement or non-releasable coupling of the body and clamping member. The operating member could be differently configured to interact with the body and clamping member forwardly of its present position. With suitable modification, the camming thread portion 69 of clamping member 38 could be disposed instead on thread 50 of main body 36.

Other camming arrangements and structures—on one or more of the base, clamping member and operating member—could also be employed in lieu of the disclosed modified thread portion. One such alternative camming arrangement is illustrated in FIG. 10. As there shown, a modified operating member 40' includes a forwardmost end 64' having standard threads 62', an intermediate portion 66' of increased diameter, and a rearmost portion 68' of further increased diameter. Unlike the operating member 40 of the embodiment of FIGS. 3–9, however, the forwardmost end 64' of modified member 40' extends axially beyond threads 64' and terminates in a nose 76. In the fully inserted or blade-clamping position of the operating member (corresponding to the FIG. 7 position of the embodiment heretofore described), nose 76 abuttingly contacts and cams against a ramp 78 which projects radially inward from the surface of modified clamping member 38' forwardly of its threaded portion 58'. Such contact or abutment causes the same pivotal movement of the clamping member as that effected and described in respect of the embodiment of FIGS. 3–9. As should be apparent, inclusion of this alternative nose-and-ramp camming arrangement obviates any need for providing the modified camming thread portion 69 shown in FIGS. 7 and 8.

Each of these suggested modifications are of course mentioned by way of example only and it is fully contemplated and intended that numerous others will occur to those skilled in the art once this disclosure becomes known.

Thus, while there have been shown and described and pointed out fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A tool head for releasably retaining a blade, comprising:

a body having a first blade receiving lip and first thread means remote from said lip;

a clamping member having a second blade receiving lip and second thread means remote from said second lip;

cooperatively interengaging hinge means on said body and clamping member for enabling connected relative pivotal movement therebetween to carry said first and second lips into and out of relative blade retaining proximity, said hinge means on each of said body and clamping member being disposed intermediate said respective lip and thread means;

a threaded operating member rotatably engageable with said first and second thread means; and camming means on at least one of said clamping member and operating member and engageable with the other of said clamping member and operating member as the operating member is rotated to a locking position to cause said relative pivotal movement of the clamping member and body about said hinge means thereby carrying said lips into blade retaining proximity for securely clamping a blade between said lips.

2. A tool head in accordance with claim 1 wherein rotation of said operating member effects axial translation thereof between a nonlocking position in which said body and clamping member are relatively pivotally disposed to position said lips in sufficiently spaced apart relation for permitting ready insertion and removable of a blade therebetween, and a locking position in which said body and clamping member are relatively pivotted to carry said lips into blade retaining proximity for securely clamping a blade therebetween.

3. A tool head in accordance with claim 2, further comprising stop means on said operating member for preventing axial movement thereof beyond said locking position as the operating member translates from said nonlocking to said locking position.

4. A tool head in accordance with claim 1 wherein said operating member is operatively insertable between said body and clamping member for rotatable engagement with said first and second thread means thereof to effect axial translation of the operating member along said body and clamping member between a nonlocking position in which said body and clamping member are relatively pivotally disposed to position said lips in sufficiently spaced apart relation for permitting ready insertion and removal of a blade therebetween, and a locking position in which said body and clamping member are relatively pivotted to carry said lips into blade retaining proximity for securely clamping a blade therebetween.

5. A tool head in accordance with claim 4 wherein in said locking position thereof the operating member is fully inserted into said body and clamping member to securely clamp a blade between said lips, and wherein rotation of said operating member to effect predetermined axial translation thereof away from said locking position causes relative pivotal movement of the body and clamping member thereby sufficiently spacing apart said lips to permit ready insertion and removal of a blade therebetween.

6. A tool head in accordance with claim 1 wherein said camming means comprises means on said second thread means of the clamping member.

7. A tool head in accordance with claim 2 wherein said camming means comprises means on said clamping member for cooperating with the operating member as the same translates to said locking position to move the operating member substantially transverse to said axial translation thereof, thereby effecting said relative pivotal movement of said body and clamping member to carry said lips into blade retaining proximity for securely clamping a blade therebetween.

8. A tool head in accordance with claim 7 wherein said camming means comprises means on said second thread means of the clamping member.

9. A tool head in accordance with claim 8 wherein said camming means comprises a thread portion on said second thread means modified to cause said substantially transverse movement of the operating member as the operating member is axially translated to said locking position thereof.

10. A tool head in accordance with claim 9 wherein said modified thread portion comprises a thread portion in which the root of the thread has a predeterminately reduced depth for causing said substantially transverse movement of the operating member at said locking position thereof.

11. A tool head in accordance with claim 4 wherein said body includes a collar proximate said first thread means, and said operating member is insertable through said collar for rotatable engagement with said first thread means and with said second thread means of the clamping member.

12. A tool head in accordance with claim 11 wherein said operating member includes stop means cooperable with said body for preventing axial movement of the operating member beyond said locking position as the operating member translates from said nonlocking to said locking position.

13. A tool head in accordance with claim 4 wherein said operating member includes a first continuous thread and wherein said first and second thread means are substantially contiguously disposed to define a substantially continuous second thread for rotatable engagement with said first thread of the operating member and along which the operating member axially translates between said nonlocking and locking positions.

14. A tool head in accordance with claim 1 wherein said hinge means comprises complimentary hook means on each of said body and clamping member for releasable mutually hinged pivotal engagement of said body and clamping member.

15. A tool head in accordance with claim 14 wherein said hinge means is predeterminately configured so that, when said operating member is rotatably engaged with said first and second thread means, said hook means of the body and clamping member are rendered non-releasable to thereby maintain said connected relative pivotal movement of the body and clamping member.

16. A tool head in accordance with claim 14 wherein said hinge means further comprises fulcrum means on at least one of said body and clamping member for facilitating relative separation of said lips as the same are carried out of blade retaining proximity by said relative pivotal movement of the body and clamping member to thereby facilitate ready insertion and removal of a blade between said separated lips.

17. A tool head in accordance with claim 16 wherein said fulcrum means comprises at least a boss on one of said body and clamping member for engagement with said hook means on the other of said body and clamping member.

18. A tool head in accordance with claim 1, further comprising elongated handle means depending from said operating member for facilitating operative rotation thereof between said locking and nonlocking positions.

19. A tool head in accordance with claim 1 wherein said camming means comprises ramp means on said clamping member engageable with said operating member to cause said relative pivotal movement of the clamping member and body in said locking position of the operating member.

20. A tool head in accordance with claim 19 wherein said camming means further comprises nose means on said operating member for engagement with said ramp means on the clamping member in said locking position of the operating member.

* * * * *